US010208966B2

(12) United States Patent
Robinson

(10) Patent No.: US 10,208,966 B2
(45) Date of Patent: Feb. 19, 2019

(54) FLUID HEATING AND/OR COOLING SYSTEM AND RELATED METHODS

(71) Applicant: ESG Pool Ventilation Limited, St. Ives, Cambridgeshire (GB)

(72) Inventor: Anthony Robinson, St. Ives (GB)

(73) Assignee: ESG POOL VENTILATION LIMITED, St. Ives, Cambridgeshire (GB)

( * ) Notice: Subject to any disclaimer, the term of this patent is extended or adjusted under 35 U.S.C. 154(b) by 20 days.

(21) Appl. No.: 15/302,756

(22) PCT Filed: Apr. 10, 2015

(86) PCT No.: PCT/GB2015/051098

§ 371 (c)(1),
(2) Date: Oct. 7, 2016

(87) PCT Pub. No.: WO2015/155543

PCT Pub. Date: Oct. 15, 2015

(65) Prior Publication Data

US 2017/0030594 A1 Feb. 2, 2017

(30) Foreign Application Priority Data

Apr. 10, 2014 (GB) ..... 1406515.5

(51) Int. Cl.
*F25B 49/02* (2006.01)
*F24D 19/10* (2006.01)
(Continued)

(52) U.S. Cl.
CPC ..... *F24D 19/1054* (2013.01); *F24D 17/02* (2013.01); *F25B 30/02* (2013.01); *F25B 49/02* (2013.01); *F25B 49/027* (2013.01); *F25B 2339/047* (2013.01); *F25B 2500/19* (2013.01); *F25B 2600/17* (2013.01); *F25B 2600/21* (2013.01); *F25B 2600/2503* (2013.01); *F25B 2600/2513* (2013.01); *F25B 2700/195* (2013.01); *F25B 2700/197* (2013.01); *F25B 2700/21161* (2013.01); *F25B 2700/21162* (2013.01); *F25B 2700/21163* (2013.01); *F25B 2700/21174* (2013.01)

(58) Field of Classification Search
CPC ..... F25B 7/00; F25B 41/062; F25B 49/022; F25B 13/00; F25B 30/02; F25B 49/02; F25B 49/027; F25B 2339/047; F25B 2500/19; Y02B 30/62; F24D 19/1054; F24D 17/02
USPC ..... 62/79, 115, 119, 129, 324.1
See application file for complete search history.

(56) References Cited

U.S. PATENT DOCUMENTS

2003/0061827 A1 4/2003 Sakakibara

FOREIGN PATENT DOCUMENTS

EP 1162419 A1 12/2001

*Primary Examiner* — Melvin Jones
(74) *Attorney, Agent, or Firm* — David W. Carstens; J. Andrew Reed; Carstens & Cahoon, LLP

(57) ABSTRACT

A method of and system for heating and/or cooling a fluid, the method comprising moving the fluid through a secondary side of a heat exchanger and controlling the temperature of a primary side of the heat exchanger such that the temperature of the primary side of the heat exchanger is maintained substantially at a determined temperature interval from a reference temperature which is a function of at least one of: a temperature of an inlet to the secondary side and a temperature of an outlet of the secondary side.

19 Claims, 2 Drawing Sheets

Figure 1:
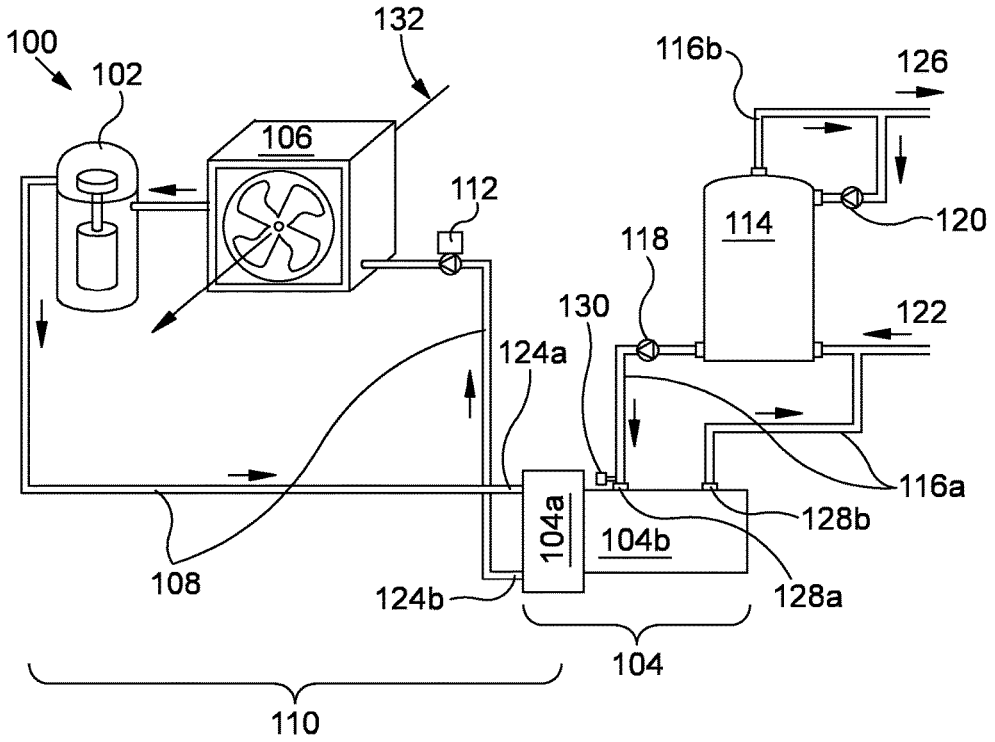

(51) Int. Cl.
*F24D 17/02* (2006.01)
*F25B 30/02* (2006.01)

FLUID HEATING AND/OR COOLING SYSTEM AND RELATED METHODS

CROSS REFERENCE TO RELATED APPLICATIONS

This application is the U.S. national phase of International Application No. PCT/GB2015/051098 filed Apr. 10, 2015, which designated the U.S. and claims priority to G.B. application number GB 1406515.5 filed Apr. 10, 2014, the entire content of which is hereby incorporated by reference.

The invention relates to a fluid heating and/or cooling system and related methods. In particular, but not exclusively, embodiments of the invention may relate to a system for transferring heat to and/or from water. In particular, but not exclusively, embodiments, may be arranged to heat a supply of water for later consumption.

It is convenient to describe the background of embodiments in relation to water heating and/or cooling. However, it will be appreciated that the principles outlined may be applied to fluids other than water.

Many water supply systems maintain a supply of water, in a storage vessel, which is then either heated and/or cooled by a heat transfer mechanism. Many prior art systems move water from the storage vessel to the heat transfer mechanism and return the water to which heat has been added or removed back to the storage vessel.

In the case of a heating system, it is known to use boilers, as the heat transfer mechanism, which burn fossil fuels to generate heat which is used to heat the water passing through the boiler. Such systems generate substantial volumes of $CO_2$ and the overall generation of the hot fluid (eg water) might not be as efficient as desired both in terms of cost and generation of $CO_2$.

According to a first aspect of the invention there is provided a fluid heating and/or cooling system arranged to heat and/or cool a fluid and comprising, at least one of the following:

1. a heat pump comprising at least one of a compressor, an evaporator having an evaporating temperature at which refrigerant therein evaporates and a condenser having a condensing temperature at which refrigerant therein condenses, connected by a refrigerant pipe-work system arranged to carry a refrigerant;
   wherein one of the condenser and the evaporator provides a heat exchanger the heat exchanger may have:
   (i) a primary inlet arranged, in use, to receive the refrigerant; and
   (ii) a secondary inlet arranged, in use, to receive the fluid; and
   (iii) a secondary outlet arranged, in use, to output the fluid;
2. a fluid storage vessel typically arranged, in use, to allow fluid therefrom to be circulated through the heat exchanger via the secondary inlet, in a heating pipe-work system;
3. at least one temperature sensor typically arranged to monitor a temperature of the fluid and to generate a temperature output; and
4. a system controller typically arranged to have input thereto the at least one temperature output and to generate a reference temperature therefrom, wherein the reference temperature is a function of the temperature of the fluid at at least one of the secondary inlet and the secondary outlet and wherein:
   (a) when the fluid is to be heated, the condenser provides the heat exchanger and the controller is further arranged to control the condensing temperature in response to the reference temperature such that the condensing temperature is maintained substantially at a determined temperature interval above the reference temperature; and/or
   (b) when the fluid is to be cooled, the evaporator provides the heat exchanger and the controller is further arranged to control the evaporating temperature in response to the reference temperature such that the evaporating temperature is maintained substantially at a determined temperature interval below the reference temperature.

Embodiments, employing heat pumps are advantageous as they provide heating and cooling within the system and systems can readily include valves to allow reversing of heat transfer direction to occur. Secondly, they use energy input to the system to move heat energy from a heat source to a heat sink, or visa versa, where the energy moved can be greater, perhaps substantially, than the energy input to the system.

Further, the efficiency of embodiments can be increased by ensuring that the condensing temperature is a determined temperature interval above the reference temperature.

In traditional heating systems, the condensing temperature is set at a level above the desired hot water temperature; i.e. the temperature to which fluid within the fluid storage vessel is to be heated. Typically this hot water temperature is 60° C. and thus, the condensing temperature is set at a temperature above this such as for example 70° C. Most, if not all, of the heating process is therefore carried out using a heating medium (the refrigerant) at a temperature higher than the temperature to which the fluid is to be heated. By contrast, in at least some of the embodiments the temperature of the refrigerant is repeatedly adjusted to a temperature above that of the fluid being heated (that is the actual temperature of the fluid rather than the desired final temperature), with the difference between the condensing temperature and the fluid temperature (i.e. the determined temperature interval) being controlled. Some embodiments are arranged to control the determined temperature interval to be the minimum achievable. Typically therefore, embodiments are arranged to control the condensing temperature to increase from a minimum at the commencement of the fluid heating, when the fluid temperature is lowest, to a maximum at the completion of the fluid heating process and therefore the average condensing temperature is lower than that in traditional systems. Such embodiments, therefore calculate a target condensing temperature which is the reference temperature plus the determined temperature interval.

Advantageously, embodiments that control the condensing temperature to be substantially a determined temperature interval above the reference temperature increase the Coefficient of Performance (COP) of the system. The COP is defined as the useful heating energy output, divided by the energy input into the heat pump compressor. For example, in such a heating system, the COP may be 8.8 when the condensing temperature is 25° C. but only 2.2 or less when the condensing temperature is of around 65° C.

Thus, the average COP of the system becomes a weighted average of the COP's over its operating range and it is believed that the average of a typical embodiment will become 5.5. It will be appreciated that embodiments that operate with such an overall COP will be more efficient at generating hot fluid and/or use less $CO_2$ than systems used to heat fluid (eg water) wherein the condensing temperature is maintained above the final temperature of the fluid.

Preferably the heat pump is an air-source heat pump, optionally it may be a ground source heat pump, a water source heat pump, or a heat pump system comprising multiple heat pumps, optionally having different external heat sources.

The condenser may comprise a heat exchanger arranged to extract heat from the refrigerant within the refrigerant pipe work system. Thus, when the system is arranged to heat the fluid, the condenser may be referred to as a condenser heat exchanger, or as a heat exchanger.

In a cooling system the positions of the condenser and the evaporator are reversed and the fluid flowing in the system is cooled. The skilled person will appreciate that the refrigerant pipe work system is a mechanism for moving heat in either a cooling or heating system. When the system is arranged to cool the fluid, the evaporator may comprise a heat exchanger arranged to extract heat from the fluid within the heating pipe work system. Thus, when the system is arranged to cool the fluid, the evaporator may be referred to as an evaporator heat exchanger, or as a heat exchanger.

In a system that is reversible between a heating and a cooling system, the system may have modifications to the refrigerant pipe work system typically including valves to change the direction of flow between the components of the refrigerant pipe-work system. The skilled person will appreciate how to do this.

In a cooling system, and when a system that is reversible between a heating and a cooling system is operating as a cooling system, the skilled person will understand that the evaporating temperature is controlled in place of the condensing temperature.

In a heating system, the difference between the condensing temperature and a temperature representative of the fluid temperature within the secondary side of the condenser heat exchanger (i.e. the fluid temperature at the secondary outlet or secondary inlet of the condenser, or at a point between the two) is typically minimised, or otherwise reduced, to optimise, or otherwise improve, the efficiency, and the condensing temperature is higher than the temperature of fluid at the secondary outlet. By contrast, in a cooling system, the difference between the evaporating temperature and a temperature representative of the fluid temperature within the secondary side of the condenser heat exchanger (i.e. the fluid temperature at the secondary outlet or secondary inlet of the condenser, or at a point between the two) is typically minimised, or otherwise reduced, to optimise, or otherwise improve the efficiency, and the evaporating temperature is lower than the temperature of fluid at the secondary outlet. The system is therefore reversed to take advantage of the same aspect of Carnot's theorem, which is a result of the second law of thermodynamics, as would be understood by the skilled person.

In the remainder of the disclosure, the heating system is described for conciseness and simplicity. The skilled person will understand, with reference to the above paragraphs, how the system and method are adjusted for cooling.

The at least one temperature sensor may be located at the secondary inlet to measure the temperature of fluid entering the condenser at the secondary inlet directly. Alternatively, or additionally, the temperature sensor may be located anywhere along the pipe from the fluid storage vessel or inside the fluid storage vessel, near this pipe; the known heat loss along the pipe, which may itself be a function of temperature, can be used to calculate the temperature at the secondary inlet.

Alternatively, or additionally, the sensor may be located at the secondary outlet from the condenser, or along the pipe from the secondary outlet to the fluid storage vessel. The known temperature difference between the secondary inlet and the secondary outlet of the condenser can be used to calculate the temperature at the secondary inlet from that at the secondary outlet. The known heat loss along the pipe may be used in addition if the temperature sensor is located along the pipe from the secondary outlet to the fluid storage vessel.

More than one temperature sensor may be provided.

The controller may be arranged to generate the reference temperature according to a function of at least one of the secondary inlet temperature and the secondary outlet temperature. In one embodiment the reference temperature may be an average of the secondary inlet and secondary outlet temperatures. However, the skilled person will appreciate that the condensing temperature must be above the highest temperature of the fluid within the secondary side of the condenser heat exchanger. Embodiments are therefore typically arranged to maintain the determined interval to be large enough to make the target condensing temperature (which is equal to the reference temperature plus the determined interval) above the highest temperature of the fluid within the secondary side of the condenser heat exchanger.

In some embodiments the temperature output may be the temperature of the fluid entering the condenser at the secondary inlet. Alternatively, the temperature of the fluid entering the condenser at the secondary inlet may be calculated from the temperature output, as described above, by the controller.

The controller, which may be a digital controller, calculates the lowest condensing temperature that will transmit the desired amount of heat from the secondary side of the condenser into the fluid in the bottom of the fluid storage vessel. This calculation may take into account of the characteristics of the condenser heat exchanger, and causes the condensing temperature to be adjusted to a target condensing temperature substantially the determined temperature interval above the reference temperature.

That is, the system controller may be arranged to vary, from time to time, the condensing temperature in response to the reference temperature. From time to time may be in real-time, or in substantially real time, or it may mean periodically. The period between variations may be for example, substantially any of the following: 1 second, 2 seconds, 4 seconds, 6 seconds, 8 seconds, 10 seconds; 20 seconds; 30 seconds; 45 seconds; 1 minute; 2 minutes; 5 minutes; or the like. Conceivably, the controller may make calculations as a shorter interval than 1 second but it is believed the lag in the control system may mean that such a short period is not necessary. The skilled person will appreciate that the period between variations should be short enough so that the temperature of the fluid being heated does not change substantially within the period so as to make the condensing temperature inaccurate according to the method outlined herein which would result in the system operating less efficiently than might be desired.

Typically, the system controller is arranged to maintain the condensing temperature such that the determined temperature interval between the target condensing temperature and the reference temperature is as low as practically possible. In this context, the lowest practical determined temperature interval, and hence the lowest practical condensing temperature, is dependent on the heat exchanger used, amongst other variables, and may mean at least one of the following:

i. low enough to ensure that complete condensation of the gas to a liquid occurs within the condenser;

ii. a determined amount above a temperature that the heating system is maintaining within the secondary side of the condenser heat exchanger, thereby allowing for heat exchange losses; and iii. leaving sufficient margin above the temperature the heating system is maintaining within the secondary side of the condenser heat exchanger to ensure that complete condensation of the gas to a liquid occurs within the condenser.

The determined amount that the condensing temperature is held above the fluid temperature at the outlet from the secondary side of the condenser heat exchanger may be substantially any of the following: 1° C., 2° C., 3° C., 4° C., 5° C., 6° C., and preferably less than 5° C.

The reference temperature is used as a measure of the temperature within the secondary side of the condenser heat exchanger but may not directly be any one of the temperatures of the fluid at the secondary inlet, at the secondary outlet, or anywhere within the secondary side of the condenser heat exchanger. The reference temperature is a known function of the temperature of the heat exchanger; i.e. the temperature at the secondary inlet, at the secondary outlet, or anywhere within the secondary side of the condenser heat exchanger is calculable using the reference temperature and known or calculable heat gains, losses and temperature gradients and differences within the system.

The heating pipe-work system may comprise a pump arranged to pump fluid around the heating pipe-work system. The pump may be of variable speed thereby allowing control of the condensing temperature. Here, it will be appreciated that the primary and secondary sides of the condenser heat exchanger are in thermodynamic balance and that the change of a parameter that affects the heat input to or output from either the primary or secondary sides will affect the equilibrium. The condensing (or evaporating) temperature, the inlet temperature and the outlet temperature are therefore interrelated values; they are mutually dependent. As such, embodiments of the invention may be thought of as optimising the functionality of the heating and/or cooling system about a range of equilibriums that are set by the heat capacities of the heating and refrigerant pipe-work systems and fluid and refrigerant respectively therein.

The heating pipe work system may comprise a by-pass pipe arranged to allow a fluid to by-pass the heating exchanger of the heating pipe work system. The heating pipe work system may also comprise a valve arranged to control the amount of fluid allowed to flow through the by-pass pipe.

The system controller may be further arranged to control the rate of flow of the fluid within the heating pipe work system through the condenser as a function of variables in addition to the temperature output. For example, these variables may include any one or more of the following: the thermal characteristics of a fluid to be heated by the heating system; the temperature characteristics of a heat exchanger associated with the fluid within the heating pipe work system. Such embodiments are advantageous in that they enable improvement, which may be optimisation, of the energy efficiency of the heating and/or cooling of the system.

In some embodiments, the condenser heat exchanger may be partially or fully located within the fluid storage vessel.

According to a second aspect of the invention there is provided a control system arranged to control the heating and/or cooling of a volume of fluid using a heat exchanger and comprising:

at least one input arranged to have input thereto the output of a temperature sensor arranged to monitor a temperature of a fluid to be heated; and wherein the controller is arranged to generate a reference temperature from the at least one temperature input thereto, wherein the reference temperature is a function of the temperature of at least one of a secondary inlet and outlet and the controller is further arranged to control a temperature of the primary side of the heat exchanger in response to the reference temperature such that the temperature of the primary side of the heat exchanger is maintained substantially at a determined temperature interval above the reference temperature.

According to a third aspect of the invention there is provided a method of heating and/or cooling a fluid within a fluid storage vessel, the method comprising moving the fluid from the storage vessel to a secondary side of a heat exchanger and controlling the temperature of the primary side of the heat exchanger such that the temperature of the primary side of the heat exchanger is maintained substantially at a determined temperature interval above a reference temperature, the reference temperature being a function of at least one of: a temperature of an inlet to the secondary side and a temperature of an outlet of the secondary side.

According to a fourth aspect of the invention there is provided a machine readable medium containing instructions which when read by a machine cause that machine to perform as the system of the first and/or second aspect of the invention or cause that machine to provide the method of the third aspect of the invention.

In any of the above aspects of the invention the machine readable medium may comprise any of the following: a floppy disk, a CD ROM, a DVD ROM/RAM (including a −R/−RW and +R/+RW), a hard drive, a solid state memory (including a USB memory key, an SD card, a Memory-stick™, a compact flash card, or the like), a tape, any other form of magneto optical storage, a transmitted signal (including an Internet download, an FTP transfer, etc), a wire, or any other suitable medium.

The skilled person will appreciate that a feature discussed in relation to one of the above aspects of the invention may be applied, mutatis mutandis, to the other of the aspects of the invention.

Reference to pipe-work system herein may also be thought of as a reference to a pipe system.

Figure 2:
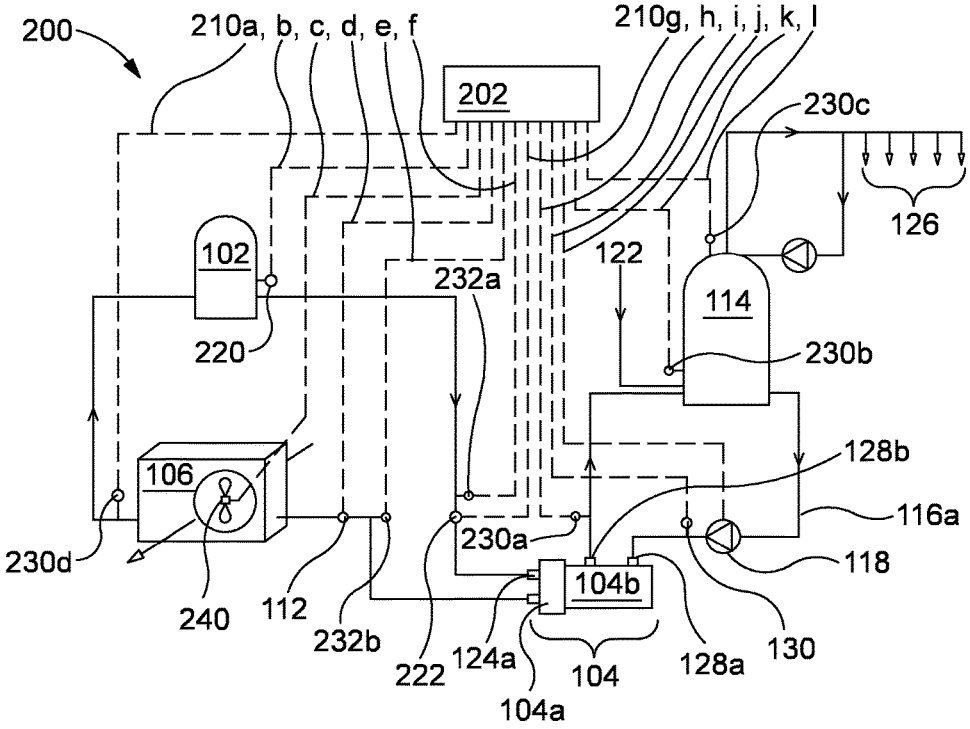

There now follows by way of example only a detailed description of an embodiment of the present invention with reference to the accompanying drawings in which:

FIG. 1 shows a schematic of an embodiment of the system in which an air source heat pump is used to heat water; and FIG. 2 shows a schematic of the controls of the embodiment of the invention shown in FIG. 1.

For reasons of clarity, it is convenient to describe an embodiment in terms of a system arranged to heat a fluid, and in particular to heat water. However, the skilled person will appreciate that other embodiments may be arranged to heat and/or cool other fluids.

The hot water heating system 100 shown in FIG. 1 is based on the use of an Air Source Heat Pump (ASHP) 110. The heating system 100 includes a compressor 102, condenser heat exchanger 104 and evaporator 106 each of which are linked by a refrigerant pipe-work system 108 and arranged to provide a refrigeration cycle. An evaporating control valve 112 is provided within the refrigerant pipe-work system 108 between the condenser 104 and the evaporator 106. The refrigerant pipe-work system 108 is arranged to conduct a refrigerant through a primary side 104*a* of the condenser heat exchanger 104.

The refrigerant flows within the refrigerant pipe-work system 108, from the evaporator 106 to the compressor 102. The gas in this pipe section is at low pressure and temperature; the compressor 102 increases the temperature and pressure, and the heated, pressurised refrigerant then flows to a primary side 104*a* of the condenser heat exchanger 104, entering via a primary inlet 124*a*, which condenses the fluid within the refrigerant pipe system 108 to a high pressure, moderate temperature, liquid, which then exits via a primary outlet 124*b*. The condenser heat exchanger 104 allows heat to be transferred from the refrigerant to the fluid. The lower temperature refrigerant is then returned, via the evaporating control valve 112, to the evaporator 106, which extracts heat from the heat source, which in this case is outside air 132. The evaporating control valve 112 (which may be thought of as an expansion control means) lets the high pressure liquid expand into the evaporator 106 to a low pressure, cool, gas.

The passage of refrigerant around the refrigerant pipe-work system 108 has been described in relative terms, such as low, medium, high. The skilled person will appreciate that these terms are described with reference to other parts of the refrigerant pipe-work system 108.

The system 100 includes a hot water storage vessel 114, a heating pipework system 116*a*, 116*b* and at least two pumps 118, 120. Cold water enters the hot water storage vessel 114 via the cold feed 122 at a bottom region of the vessel 114. The cold water entering the vessel 114 here replaces the water leaving the vessel 114 via water pipe-work system 116*b* to be used for hot water services 126 such as washing, showers, baths and the like.

At the same time, in order to heat the water for washing, the water pipework system 116*a* circulates cold water from the bottom region of the tank to a secondary side 104*b* of the condenser heat exchanger 104. The water flowing into the secondary side 104*b* is heated with heat from the primary side 104*a* of the condenser heat exchanger 104 and returned to the vessel 114.

Hot water in the vessel 114 stratifies so that hot water can be stored for use in the top of the vessel, while colder water enters and is heated at lower levels in the vessel.

The temperature sensor 130 measures the temperature of the water in a region of the secondary inlet 128*a* of the condenser heat exchanger 104.

In alternative embodiments, the temperature sensor 130 is located elsewhere on the pipework loop 116*a* or within the vessel 114, near the entrance to pipework loop 116*a*. In such embodiments, the skilled person will appreciate that there is typically a known temperature drop around points of the heating pipe-work system and the temperature of the water at the secondary inlet 128*a* can be determined from other points of the heating pipe-work system.

The temperature sensor 130 provides a temperature output.

In alternative or additional embodiments, the system further comprises additional temperature and/or temperature/pressure sensors. Advantageously, such sensors are positioned at the inlet and/or outlet of the compressor 102 and/or evaporator 106 and at one or more positions in or near the fluid storage vessel 114.

In addition to the valve 112 the refrigerant pipe work system also comprises a further valve 222 arranged to control the rate at which refrigerant can pass.

FIG. 2 shows a control system 200 of the embodiment described above. In particular, a controller 202 is provided to accept inputs, as described below, and process those inputs to control the system described in relation to FIG. 1.

Conveniently, the controller 202 comprises a processor. The processor may be any suitable processor such as Intel™ i3™, i5™, i7™ or the like; an AMD™ Fusion™ processor; and Apple™ A7™ processor.

This temperature output from the temperature sensor 130 is provided as an input to the control system controller 202. The controller 202 controls the condensing temperature of condenser heat exchanger 104 in response to the temperature output such that the condensing temperature is a determined temperature interval above a reference temperature generated from the temperature of the water entering the secondary inlet 128*a*.

In this embodiment, the temperature output represents the temperature of the water entering the secondary inlet 128*a*. In alternative or additional embodiments, the temperature sensor 130 is located at or near the secondary outlet 128*b* and the temperature output represents the temperature of the water leaving the secondary outlet 128*b*. The reference temperature is then generated by the controller 202 using the temperature output.

In additional or alternative embodiments, the temperature sensor 130 is not located at the secondary inlet 128*a* or outlet 128*b* and is instead located elsewhere in the region of pipework 116*a*; the temperature of the fluid entering the secondary inlet 128*a* or leaving the secondary outlet 128*b* is calculable using the temperature output and other factors such as heat loss from pipes and temperature difference between the secondary inlet 128*a* and the secondary outlet 128*b*. The temperature output is therefore a known function of the temperature of the water entering the secondary inlet 128*a* and/or the temperature of the water leaving the secondary outlet 128*b*. The reference temperature is then generated from the temperature output by the controller 202.

There is a temperature gradient across the secondary side 104*b* of the condenser heat exchanger 104 and the reference temperature is some function based upon at least one temperature within the secondary side 104*b*. In some embodiments, the reference temperature is the average temperature between the secondary inlet 128*a* and the secondary outlet 128*b*.

In the present embodiment, the determined temperature interval is pre-set by a user or by software provided with the condenser heat exchanger 104. In other embodiments, controller 202 calculates the temperature interval to use based upon factors including one or more of the following:

(i) the type of heat exchanger;
(ii) the water temperature at the secondary inlet;
(iii) maximum and minimum condensing temperatures of the condenser;
(iv) the reference temperature; and
(v) the desired hot water temperature; i.e. the temperature to which fluid within the fluid storage vessel is to be heated.

The controller 202 then causes the compressor 102 and/or the evaporator control valve 112 to regulate the flow rate and/or pressure and temperature of the refrigerant, within the refrigerant pipe-work so as to reduce or increase the condensing temperature within the condenser heat exchanger 104 so that the condensing temperature is, or is close to, the reference temperature plus the determined temperature difference.

In the description below, the connections between the controller 202 and the various components are described as wired connections. These connections may operate over any suitable protocol, such as RS232; RS485; TCP/IP; USB;

Firewire; or the like; or a proprietary protocol. However, in other embodiments, it is also possible for the connections to be wireless in which case protocols such as Bluetooth; WIFI; or a proprietary protocol may also be suitable.

In the embodiment shown in FIG. 2, the controller 202 communicates with the compressor 102 and the temperature sensor 130 electronically via wired communication channels 210*b* and 210*i* respectively. The controller 202 controls the compressor 102 to modulate the compressor 102 so as to allow adjustment of the condensing temperature.

In some embodiments, the controller 202 also communicates with one or more of valves 112, 222 on the primary and secondary sides of the compressor 102, so as to regulate flow through the compressor 102 and hence adjust the condensing temperature.

In alternative or additional embodiments, the controller 202 communicates with further temperature sensors such as the below to provide additional data/feedback. Thus, each of the following temperature sensors is arranged to generate a temperature output which is input to the controller 202:

230*a* in a region of the secondary outlet 128*b* of the heat pump condenser 104;

230*b* in a region of the lower level of the fluid storage vessel 114;

230*c* in a region of the higher level of the fluid storage vessel 114; and

230*d* in a region of the outlet of the evaporator 106.

In alternative or additional embodiments, the controller 202 communicates with pressure/temperature sensors 232*a*, 232*b* in a region of the primary condenser inlet 124*a* and/or in a region of the evaporator 106 inlet.

Advantageously, embodiments that utilise temperature sensors in addition to temperature sensor 103 increase the accuracy of the reference temperature and/or temperature interval calculation and/or to further optimise the heating system.

The controller 202 also communicates with some or all of output control mechanisms 220, 112 and 222. The controller 202 can modulate the output of the compressor 102 by means of the compressor motor controller 220. Additionally or alternatively, the controller 202 can cause the evaporator expansion valve 112 and the condenser control valve 222 to be opened or closed or adjusted between the two extreme positions. Additionally or alternatively, the controller 102 can regulate the evaporator fan motor 240 and the condenser secondary pump 118.

The invention claimed is:

1. A fluid heating and/or cooling system arranged to heat and/or cool a fluid to a desired temperature, the desired temperature being the temperature to which fluid within the fluid heating and/or cooling system is to be heated or cooled, the fluid heating and/or cooling system comprising:

a heat pump comprising a compressor, an evaporator having an evaporating temperature at which refrigerant therein evaporates and a condenser having a condensing temperature at which refrigerant therein condenses, connected by a refrigerant pipe-work system arranged to carry a refrigerant;

wherein one of the condenser and the evaporator provides a heat exchanger between the fluid and the refrigerant;

the heat exchanger having:

(i) a primary inlet arranged, in use, to receive the refrigerant;

(ii) a secondary inlet arranged, in use, to receive the fluid; and (iii) a secondary outlet arranged, in use, to output the fluid;

a fluid storage vessel arranged, in use, to allow fluid therefrom to be circulated through the heat exchanger via the secondary inlet, and to receive fluid returned from the secondary outlet, in a heating pipe-work system;

at least one temperature sensor arranged to monitor a temperature of the fluid and to generate a temperature output; and a system controller arranged to have input thereto the at least one temperature output and to generate a reference temperature from the at least one temperature input thereto, wherein the reference temperature is a function of the temperature of at least one of a secondary inlet and outlet of the heat exchanger and the controller is further arranged to control a temperature of the primary side of the heat exchanger in response to the reference temperature such that the temperature of the primary side of the heat exchanger is repeatedly adjusted so as to remain substantially at a determined temperature interval from the reference temperature as the fluid approaches the desired temperature.

2. The fluid heating and/or cooling system of claim 1 wherein:

(a) when the fluid is to be heated, the condenser provides the heat exchanger, the temperature of the primary side is the condensing temperature, and the controller is further arranged to control the condensing temperature in response to the reference temperature such that the condensing temperature is maintained substantially at a determined temperature interval above the reference temperature; and/or (b) when the fluid is to be cooled, the evaporator provides the heat exchanger, the temperature of the primary side is the evaporating temperature, and the controller is further arranged to control the evaporating temperature in response to the reference temperature such that the evaporating temperature is maintained substantially at a determined temperature interval below the reference temperature.

3. The system of claim 1 wherein the temperature sensor is located in a region of the secondary inlet of the heat exchanger such that the temperature of the secondary inlet can be determined.

4. The system of claim 1 wherein the temperature sensor is not located at the secondary inlet and wherein the controller is arranged to calculate the temperature of the fluid entering the secondary inlet using the temperature output.

5. The system of claim 1 in which there exists a known temperature gradient between the primary side of the heat exchanger through which refrigerant flows and a secondary side of the heat exchanger through which the fluid flows and the determined temperature interval substantially corresponds to the temperature gradient.

6. The system of claim 1 in which the controller is arranged to maintain at least one of the following:

(i) the condensing temperature at a minimum whilst still ensuring that heat transfer occurs between the refrigerant and the fluid; and/or (ii) the evaporating temperature at a maximum whilst still ensuring that heat transfer occurs between the refrigerant and the fluid.

7. The system of claim 6 in which the minimum means a temperature difference of between 1 and 6 degrees centigrade between the condensing temperature and a temperature of the fluid at an outlet from a secondary side of the heat exchanger.

8. The system of claim 6 in which the maximum means a temperature difference of between 1 and 6 degrees centigrade between the evaporating temperature and a temperature of the fluid at the outlet from a secondary side of the heat exchanger.

9. The system of claim 1 wherein the heat pump is at least one of the following:

(i) an air-source heat pump;

(ii) a ground source heat pump; and (iii) a water source heat pump.

10. The system of claim 1 wherein a target condensing temperature and/or evaporating temperature is calculated by the controller, wherein the calculation uses factors including one or more of the following:

(i) type of heat exchanger;

(ii) the fluid temperature at the secondary inlet;

(iii) maximum and/or minimum condensing temperatures of the condenser;

(iv) maximum and/or minimum evaporating temperatures of the evaporator;

(v) losses in the fluid heating system; and (vi) a target fluid temperature of the fluid within the fluid storage vessel.

11. A control system arranged to control the heating and/or cooling of a volume of fluid contained within a fluid storage vessel to a desired temperature, the desired temperature being the temperature to which the volume of fluid is to be heated or cooled using a heat exchanger, the control system comprising:

at least one input arranged to have input thereto the output of a temperature sensor arranged to monitor a temperature of the fluid to be heated or cooled; and wherein a controller is arranged to generate a reference temperature from the at least one temperature input thereto, wherein the reference temperature is a function of the temperature of at least one of a secondary inlet and outlet of the heat exchanger, through which the fluid flows, and the controller is further arranged to control a temperature of a primary side of the heat exchanger, through which refrigerant flows, in response to the reference temperature such that the temperature of the primary side of the heat exchanger is repeatedly adjusted so as to remain substantially at a determined temperature interval from the reference temperature as the fluid approaches the desired temperature.

12. The system of claim 11 in which, within the heat exchanger that the control systems is arranged to control, there exists a known temperature gradient between the primary side of the heat exchanger and the secondary side of the heat exchanger and the determined temperature interval substantially corresponds to the temperature gradient.

13. The system of claim 11 in which the controller is arranged to maintain the temperature of the primary side at a minimum whilst still ensuring that heat transfer occurs between the refrigerant and the fluid, when the system is arranged to heat the fluid.

14. The system of claim 11 in which the controller is arranged to maintain the temperature of the primary side at a maximum whilst still ensuring that heat transfer occurs between the refrigerant and the fluid, when the system is arranged to cool the fluid.

15. The system of claim 13 in which the minimum and/or maximum means a temperature difference between the temperature of the primary side and a temperature of the fluid at an outlet from a secondary side of the heat exchanger of between 1 and 7 degrees centigrade.

16. The system of claim 13 in which the minimum and/or maximum means a temperature difference between the temperature of the primary side and a temperature of the fluid at an outlet from a secondary side of the heat exchanger of between 1 and 4 degrees centigrade.

17. A method of heating and/or cooling a fluid within a fluid storage vessel to a desired temperature, the desired temperature being the temperature to which fluid within the fluid storage vessel is to be heated or cooled, the method comprising moving the fluid from the storage vessel through a secondary side of a heat exchanger and back to the fluid storage vessel, and controlling the temperature of a primary side of the heat exchanger such that the temperature of the primary side of the heat exchanger is repeatedly adjusted so as to remain substantially at a determined temperature interval from a reference temperature which is a function of at least one of a temperature of an inlet to the secondary side and a temperature of an outlet of the secondary side as the fluid approaches the desired temperature.

18. The method of claim 17 in which the primary side of the heat exchanger comprises a portion of a condenser within a refrigeration cycle.

19. The method of claim 17 in which the primary side of the heat exchanger comprises a portion of an evaporator within a refrigeration cycle.

* * * * *